US012371299B2

(12) United States Patent
Dandekar et al.

(10) Patent No.: US 12,371,299 B2
(45) Date of Patent: Jul. 29, 2025

(54) SYSTEM FOR DEFLECTING AN INTERMEDIATE ITEM IN A FOLDING UNIT

(71) Applicants: Sanjay Madhav Dandekar, Pune (IN); Datta Hari Deshpande, Pune (IN)

(72) Inventors: Sanjay Madhav Dandekar, Pune (IN); Datta Hari Deshpande, Pune (IN)

( * ) Notice: Subject to any disclaimer, the term of this patent is extended or adjusted under 35 U.S.C. 154(b) by 119 days.

(21) Appl. No.: 18/269,221

(22) PCT Filed: Dec. 22, 2021

(86) PCT No.: PCT/IB2021/062180

§ 371 (c)(1),
(2) Date: Jun. 22, 2023

(87) PCT Pub. No.: WO2022/137158

PCT Pub. Date: Jun. 30, 2022

(65) Prior Publication Data

US 2024/0043238 A1 Feb. 8, 2024

(30) Foreign Application Priority Data

Dec. 23, 2020 (IN) ..... 202021056084

(51) Int. Cl.
*B65H 45/18* (2006.01)
*B65H 29/52* (2006.01)

(52) U.S. Cl.
CPC ..... *B65H 45/18* (2013.01); *B65H 29/52* (2013.01); *B65H 2301/17* (2013.01); *B65H 2404/7412* (2013.01); *B65H 2701/13212* (2013.01)

(58) Field of Classification Search
CPC ..... B65H 45/18; B65H 2701/13212; B65H 2301/17; B65H 2404/7412; B65H 29/52
See application file for complete search history.

(56) References Cited

U.S. PATENT DOCUMENTS 1,883,152 A * 10/1932 Waterworth ..... B65H 45/18 493/444
3,698,705 A * 10/1972 Funk ..... B65H 45/18 493/19
3,804,399 A * 4/1974 Rupp ..... B65H 45/144 493/443
4,850,945 A * 7/1989 Whittenberger ..... B65H 45/148 493/420

(Continued)

FOREIGN PATENT DOCUMENTS

DE 19612955 C1 * 6/1997 ..... B65H 45/10
JP 5904222 B2 * 4/2016 ..... B65H 45/18

*Primary Examiner* — Anna K Kinsaul
*Assistant Examiner* — Mobeen Ahmed
(74) *Attorney, Agent, or Firm* — Vani Moodley, Esq.

(57) ABSTRACT

A mechanism (100*a* or 100*b*) for preventing the folding of an intermediate item (300) in a knife folder (200) is disclosed. The mechanism (100*a* or 100*b*) includes a deflector (50) that is movable between a non-operating position (50*a*) and an operating position (50*b*). When the intermediate item is moving on the folding rollers (230*a* and 230*b*) of the knife folder (200), the deflector (50) is moved to the operating position (50*b*) for deflecting the received intermediate item towards a roller gap (232) of the folding rollers by the deflector end (20) of the deflector. Upon rotating the folding rollers, the intermediate item (300) moves away from the knife folder (200) through the roller gap (232) preventing folding of the intermediate item (300).

14 Claims, 9 Drawing Sheets

(56) References Cited

U.S. PATENT DOCUMENTS

| | | | | |
|---|---|---|---|---|
| 5,044,617 | A * | 9/1991 | Roberts | B65H 45/144 270/45 |
| 5,125,633 | A * | 6/1992 | Fecker | B65H 45/148 270/45 |
| 5,743,517 | A * | 4/1998 | Bergeron | B65H 29/12 270/47 |
| 6,086,522 | A * | 7/2000 | Hechler | B65H 45/147 493/34 |
| 6,568,668 | B1 * | 5/2003 | Wakabayashi | B65H 45/161 270/58.11 |
| 6,857,996 | B2 * | 2/2005 | Dorer | B65H 45/144 270/32 |
| 7,077,798 | B2 * | 7/2006 | Kawatsu | B65H 45/18 493/434 |
| 9,102,116 | B2 * | 8/2015 | Suzuki | B65H 45/30 |
| 2004/0120745 | A1 * | 6/2004 | Yamakawa | B65H 45/14 270/41 |
| 2005/0277537 | A1 * | 12/2005 | Matsushita | B65H 45/18 493/444 |
| 2015/0266256 | A1 * | 9/2015 | Haydt, III | B65H 45/144 493/419 |
| 2020/0391970 | A1 * | 12/2020 | Vromen | B65H 29/60 |

* cited by examiner

200

200

SYSTEM FOR DEFLECTING AN INTERMEDIATE ITEM IN A FOLDING UNIT

FIELD OF THE INVENTION

The present invention relates to a mechanism for preventing the folding of an intermediate item. More specifically, the present invention relates to a mechanism for preventing the folding of an intermediate item in a knife folder. The intermediate item is a sheet having one or more folds thereon. The sheet can be made from paper.

BACKGROUND OF THE INVENTION

Generally, existing knife folders are used to fold articles made from paper or a sheet for making final folded articles. Knife folders are widely used as folding units of paper folding machinery for making pharmaceutical inserts & outserts. Patent application IN201921044995 provides the details of one of such paper folding machinery.

FIG. 1*a*. 1*b* and 1*c* show schematic views of an existing knife folder (200). The knife folder (200) includes a knife blade (210), a stopper (220) and one or more pairs of folding rollers (230*a* and 230*b*). The knife blade (210) is movable between a non-operating knife position (210*a*) and an operating knife position (210*b*). The knife folder (200) folds an intermediate item (300). The intermediate item (300) is a sheet having one or more folds thereon. The intermediate item (300) is moved on (over) the folding rollers (230*a* and 230*b*) for folding the intermediate item (300) by the knife folder (200). The intermediate item (300) is transferred to the knife folder (200) by feeding rollers (205*a* and 205*b*). The knife folder (200) receives the intermediate item (300) through a conveyor (203) at an inlet (203*a*) (FIG. 1*a*) with a linear movement in an entry direction (303). The stopper (220) restricts a linear movement of the intermediate item (300) on the folding rollers (230*a* and 230*b*) in the entry direction (302). The knife blade (210) is moved to the operating knife position (210*b*) to press on a fold line (303*b*) (FIG. 1*b*) of the received intermediate item (300).

Further, the folding rollers (230*a* and 230*b*) are rotated to fold the intermediate item (300) and move the folded intermediate item (300*a*) through a roller gap (232) (FIG. 1*c*) between the folding rollers (230*a* and 230*b*). The non-operating knife position (210*a*) (FIG. 1*a*) is a position of the knife blade (210) at which the knife blade (210) is not in physical contact with the intermediate item (300).

There is often a need to prevent the folding of the intermediate item (300) in the knife folder (200). This need for preventing the folding of the intermediate item (300) may be due to various circumstances. One example of such circumstance is a need to reduce the number of folds or cross folds of an intermediate item for making final products such as outserts.

To prevent the folding of the intermediate item (300) in the knife folder (200), if the movement of the knife blade (210) is stopped at the non-operating knife position (210*a*), the intermediate item (300) remains inside the knife folder (200) on the folding rollers (230*a* and 230*b*).

For preventing the folding of the intermediate item (300) in the knife folder (200), transferring the intermediate item (300) to the knife folder (200) can be avoided. But, generally, the knife folder (200) is used as one of the machines of machinery (not shown) for making final folded products (such as outserts). Suppose a position of the knife folder (200) is between two other machines of the machinery. In that case, the knife folder (200) needs to be removed from the machinery to avoid transferring the intermediate item (300) to the knife folder (200). This removal process is a time-consuming activity and increases the duration of the machine set-up time for preventing the folding of the intermediate item.

Therefore, there is a need for a mechanism for preventing the folding of an intermediate item in a knife folder.

OBJECTS OF THE INVENTION

An object of the present invention is to provide a mechanism for preventing the folding of an intermediate item in a knife folder.

Another object of the present invention is to provide a mechanism for preventing folding an intermediate item in a knife folder; the mechanism moves the unfolded intermediate item from the knife folder.

Still, another object of the present invention is to provide a mechanism for preventing the folding of an intermediate item in a knife folder even if the intermediate item is transferred to the knife folder.

Yet another object of the present invention is to provide a mechanism for preventing folding of an intermediate item in a knife folder; the mechanism avoids the need of removing the knife folder from machinery between two other machines of the machinery when there is a need to prevent folding of the intermediate item in the knife folder, thereby reduces the duration of the machine set up a time for preventing folding of the intermediate item.

SUMMARY OF THE INVENTION

According to the present invention, there is provided with a mechanism for preventing the folding of an intermediate item in a knife folder. The intermediate item is a sheet having one or more folds thereon. The knife folder is a folding device described in the background section of this specification (with reference to FIG. 1). The mechanism includes a deflector.

The deflector is movably arranged on a frame of a knife folder. The deflector is movable between a non-operating position and an operating position. The non-operating position is a position of the deflector at which a deflector end of the deflector is not in physical contact with an intermediate item received at the knife folder. The operating position is a position where the deflector end of the deflector is physically in contact with the intermediate item.

For preventing the folding of the intermediate item by the knife folder, when the intermediate item is moving on folding rollers of the knife folder, the deflector is moved to the operating position for deflecting the received intermediate item towards a roller gap of the folding rollers by the deflector end of the deflector. Upon rotating the folding rollers, the intermediate item moves away from the knife folder through the roller gap.

In one of the embodiments of the mechanism, the deflector is moved to the operating position when the knife blade is at the non-operating knife position.

In one more embodiment of the mechanism, when the deflector is at the operating position if the knife blade moves towards the operating knife position, the knife blade is moved backwards from an interference position towards the non-operating knife position. The interference position is a position where the deflector and the knife blade have a physical contact therebetween.

The mechanism includes a first controller, a second controller and a detecting unit. The first controller is connected to the deflector to control the deflector's movements between the non-operating position and the operating position. The second controller is connected to the knife blade for controlling movements of the knife blade between the non-operation knife position and the operation knife position. The detecting unit is connected to the second controller to provide information about the knife blade's position at the interference position to the second controller. The second controller is adapted to move the knife blade backwards from the interference position towards the non-operating knife position.

In one of the embodiments of the mechanism, the mechanism includes a guiding member connected to the frame of the knife folder. The guiding member extends towards the roller gap with a distal end of the guiding member at a predefined first distance from the roller gap. The deflector is slidably moved on the guiding member from the non-operating position to the operating position by applying an external force thereon. The external force can be applied manually or by a first force applying unit connected to the deflector. In one of the embodiments of the mechanism, the guiding member is angularly oriented with reference to the entry direction.

In one more embodiment of the mechanism, an angle between a direction of extension of the guiding member and a direction of extension of the knife blade is in a range of 20 to 160 degrees in an anti-clock wise direction.

In one more embodiment of the mechanism, the mechanism includes a fulcrum lever pivotally connected to the frame of the knife folder at a pivotal pin. The deflector is mounted on a first bar end of the fulcrum lever. When the deflector is at the operating position, the first bar end is at a predefined second distance from the roller gap. The fulcrum lever enables revolving movements of the deflector between the non-operating position and the operating position around the pivotal pin when an external force applied on the fulcrum lever accordingly. The external force can be applied manually or by a second force applying unit connected to the fulcrum lever.

In one more embodiment of the mechanism, the deflector end has a concave surface face. The concave surface face is projected away from the deflector. The concave surface face includes a centre concave portion and a lower concave surface. The centre concave portion is adapted to stop the linear movement of the intermediate item in the entry direction when the moving intermediate item touches the centre concave portion. The lower concave surface is adapted to deviate the movement of the intermediate item towards the roller gap.

In one more embodiment of the mechanism, the deflector end has a straight-line surface face. The straight-line surface face is projected away from the deflector. The straight-line surface face includes a centre portion and a lower straight surface. The centre portion is adapted to stop the linear movement of the intermediate item in the entry direction when the moving intermediate item touches the centre portion. The lower straight surface is adapted to deviate the movement of the intermediate item towards the roller gap.

In one more embodiment of the mechanism, the deflector end is angularly oriented from a direction of extension of the deflector. In one more embodiment of the mechanism, the mechanism includes a latching unit for latching the deflector between the operating and non-operating positions.

BRIEF DESCRIPTION OF THE DRAWINGS

The advantages and features of the present invention will be understood better with reference to the following detailed description of some embodiments of the and claims taken in conjunction with the accompanying drawings, wherein like elements are identified with like symbols, and in which;

DETAILED DESCRIPTION OF THE INVENTION

An embodiment of this invention, illustrating its features, will now be described in detail. The words "comprising," having, "containing," and "including," and other forms thereof, are intended to be equivalent in meaning and be open-ended in that an item or items following any one of these words is not meant to be an exhaustive listing of such item or items or meant to be limited to only the listed item or items.

The terms "first," "second," and the like, herein do not denote any order, quantity, or importance, but rather are used to distinguish one element from another, and the terms "an" and "a" herein do not denote a limitation of quantity, but rather denote the presence of one or more one of the referenced items.

The disclosed embodiments are merely exemplary of the invention, which may be embodied in various forms.

Figure 1A:
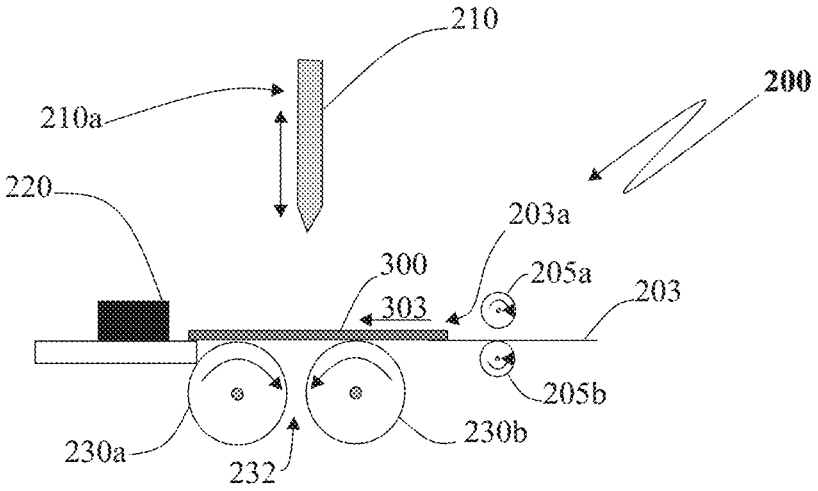
Figure 1a (Prior art)
FIGS. 1*a*, 1*b* and 1*c* shows schematic views of an existing knife folder with a knife blade of the knife folder at various positions.
Figure 1B:
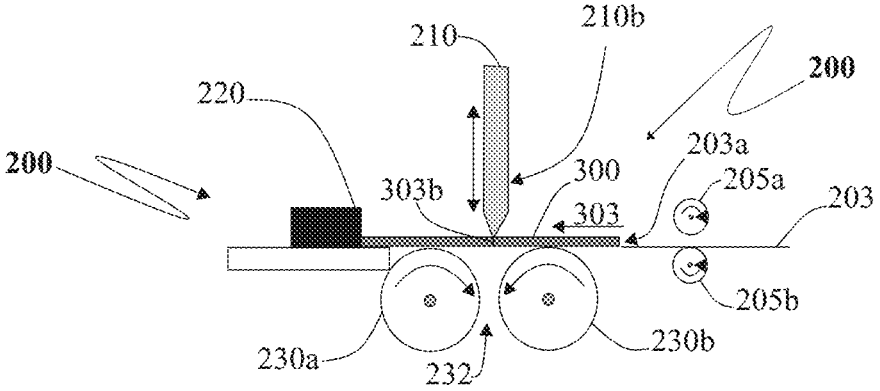
Figure 1b (Prior art)
Figure 1C:
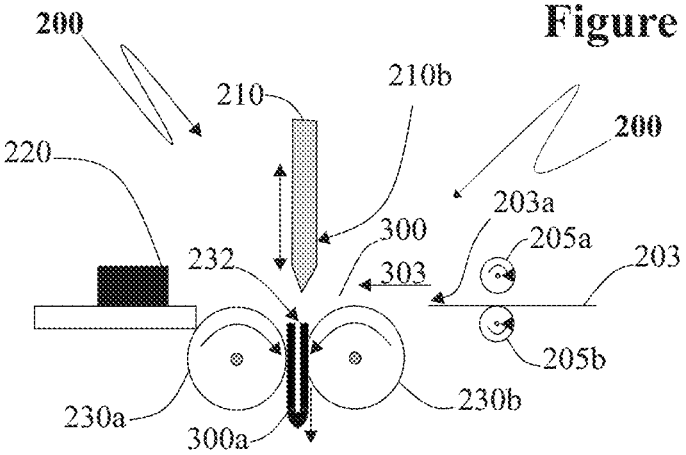
Figure 1c (Prior art)

The present invention provides a mechanism (100*a* or 100*b*) for preventing the folding of an intermediate item (300) in a knife folder (200) (refer to FIGS. 1*a*, 1*b* & 1*c*). The intermediate item (300) is a sheet having one or more folds (302, 304) thereon. The knife folder (200) (refer to FIG. 1*a*) is a folding device. The knife folder (200) includes a knife blade (210), a stopper (220) and one or more pairs of folding rollers (230*a* and 230*b*). The knife blade (210) is movable between a non-operating knife position (210*a*) and an operating knife position (210*b*). The knife folder (200) folds an intermediate item (300). The intermediate item (300) is a sheet having one or more folds thereon. The intermediate item (300) is moved on (over) the folding rollers (230*a* and 230*b*) for folding the intermediate item (300) by the knife folder (200). The intermediate item (300) is transferred to the knife folder (200) by feeding rollers (205*a* and 205*b*). The knife folder (200) receives the intermediate item (300) through a conveyor (203) at an inlet (203*a*) (FIG. 1*a*) with a linear movement in an entry direction (303). The stopper (220) restricts a linear movement of the intermediate item (300) on the folding rollers (230*a* and 230*b*) in the entry direction (302). The knife blade (210) is moved to the operating knife position (210*b*) to press on a fold line (303*b*) (FIG. 1*b*) of the received intermediate item (300).

Further, the folding rollers (230*a* and 230*b*) are rotated to fold the intermediate item (300) and move the folded intermediate item (300*a*) through a roller gap (232) (FIG. 1*c*) between the folding rollers (230*a* and 230*b*). The non-operating knife position (210*a*) (FIG. 1*a*) is a position of the knife blade (210) at which the knife blade (210) is not in physical contact with the intermediate item (300).

Figure 2A:
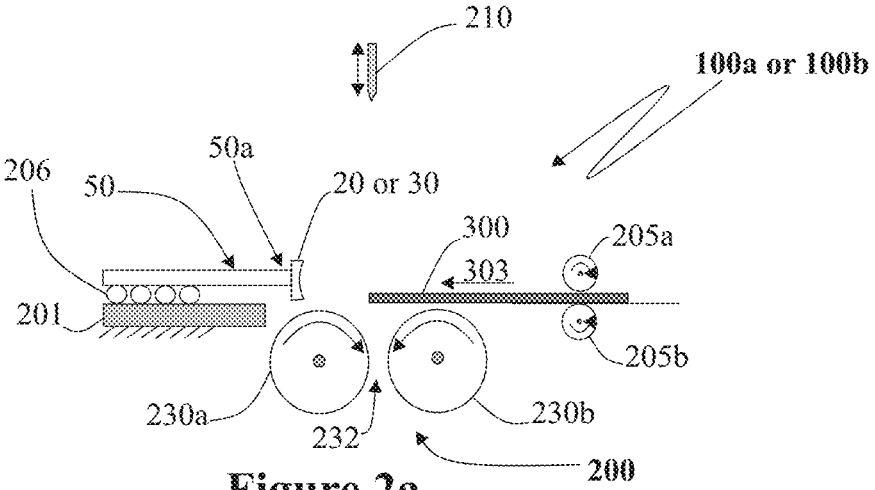
FIGS. 2*a*, 2*b*, 2*c* shows schematic views of a mechanism for preventing folding of an intermediate in the knife folder shown in FIGS. 1*a*, 1*b* and 1*c* in accordance with the present invention.
Figure 2B:
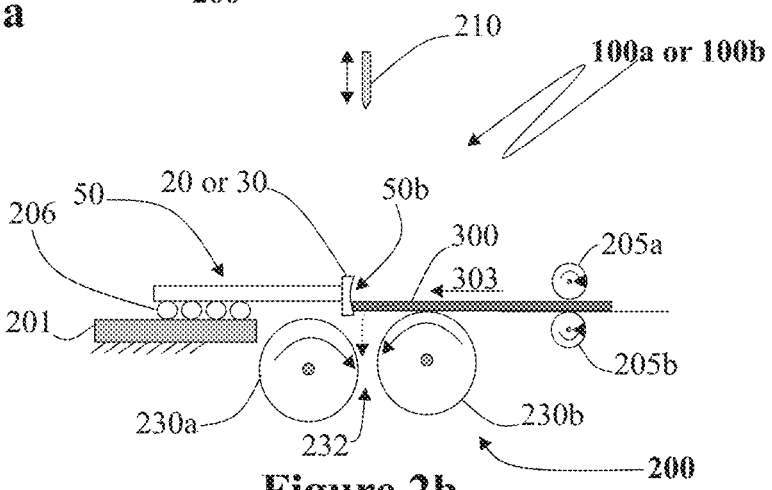
Figure 2C:
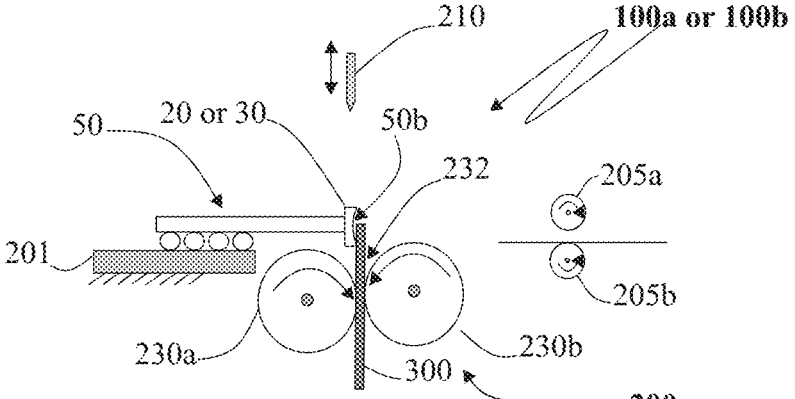

Referring now to FIGS. 2*a*, 2*b* and 2*c*, schematic diagrams of a mechanism (100*a* or 100*b*) for preventing folding of an intermediate item (300) in the knife folder (200) in accordance with the present invention is illustrated.

The mechanism (100*a* or 100*b*) includes a deflector (50). The deflector (50) is movably arranged on a frame (201) of a knife folder (200). The frame (201) is any one of the body members of the knife folder (200). The deflector (50) is movable between a non-operating position (50*a*) (FIG. 1*a*) and an operating position (50*b*). The non-operating position (50*a*) (FIG. 1*a*) is a position of the deflector (50) at which a deflector end (20 or 30) of the deflector (50) is not in a physical contact with an intermediate item (300) received at the knife folder (200).

The operating position (50*b*) (FIG. 2*b*) is a position where the deflector end (20) of the deflector (50) is physically in contact with the intermediate item (300).

Figure 2D:
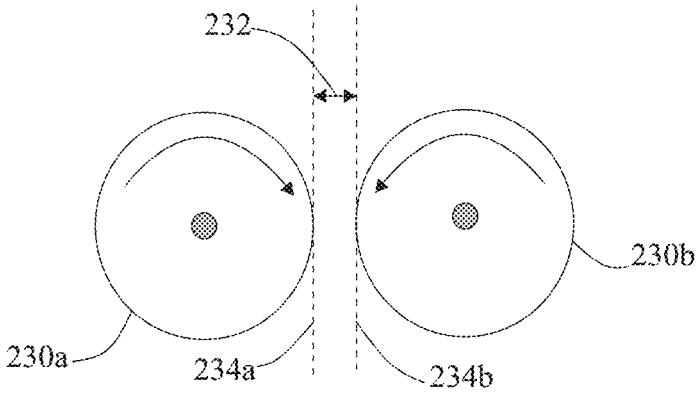
FIG. 2*d* shows an enlarged view of folding rollers of the knife folder shown in FIGS. 1*a*, 1*b* and 1*c;*

For preventing the folding of the intermediate item (300) by the knife folder (200), when the intermediate item (300) is moving on the folding rollers (230*a* and 230*b*), the deflector (50) is moved to the operating position (50*b*) for deflecting the received intermediate item (300) towards a roller gap (232) of the folding rollers (230*a* and 230*b*) by the deflector end (20) of the deflector (50). The deflector (50) is moved on a movement facilitator (206). The movement facilitator (206) can be linear bearing or slide rollers and the like. The roller gap (232) (refer to FIG. 2*d*) is a parallel distance between tangents (234*a* and 234*b*) of the folding rollers (230*a* and 230*b*). Upon rotation of the folding rollers (230*a* and 230*b*), the intermediate item (300) moves away from the knife folder (200) through the roller gap (232). Due to the cumulative moving forces applied by feeding rollers (205*a* and 205*b*) and the folding rollers (230*a* and 230*b*), the unfolded intermediate item (300) moves away from the knife folder (200). The unfolded intermediate item (300) can be transferred to a predefined destination.

Figure 3A:
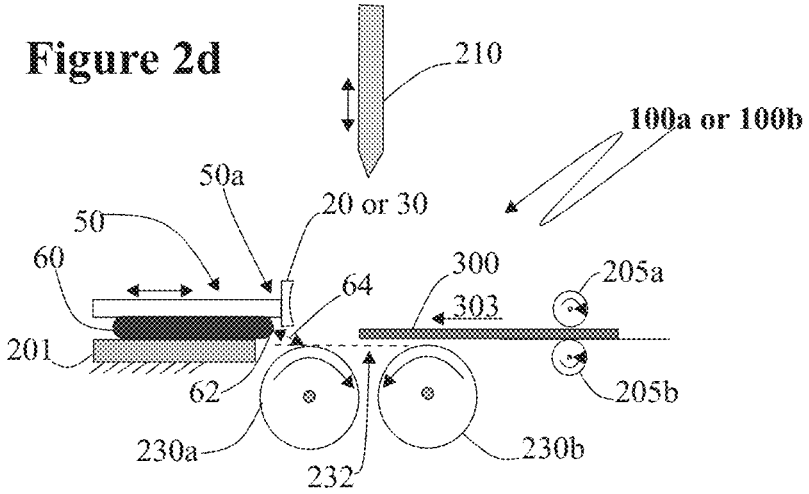
FIGS. 3*a* and 3*b* shows schematic views of one more embodiment of a mechanism for preventing folding of an intermediate in the knife folder shown in FIGS. 1*a*, 1*b* and 1*c* in accordance with the present invention.
Figure 3B:
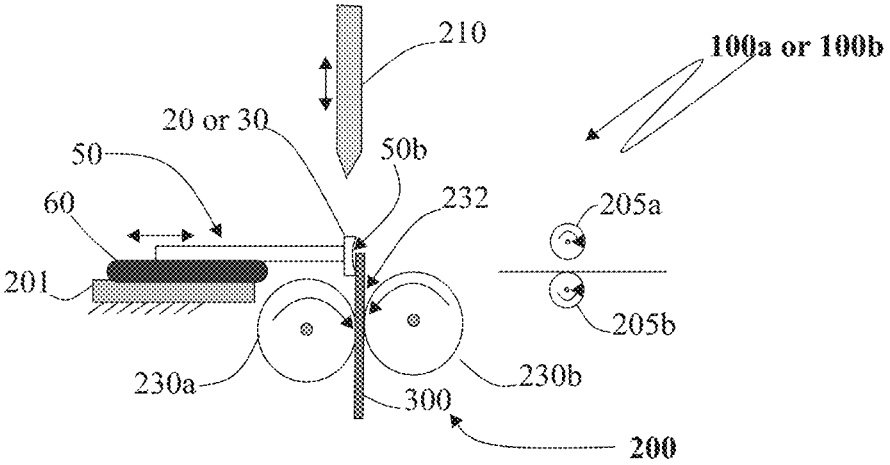

In one of the embodiments of the mechanism (100*a* or 100*b*), as shown in FIGS. 3*a* and 3*b*, the mechanism (100*a* or 100*b*) include a guiding member (60) connected to the frame (201) of the knife folder (200). The guiding member (60) is extending towards the roller gap (232) with a distal end (62) of the guiding member (60) at a predefined first distance (64) (FIG. 3*a*) from the roller gap (232). The deflector (50) is slidably moved on the guiding member (60) from the non-operating position (50*a*) (FIG. 3*a*) to the operating position (50*b*) (FIG. 3*b*) by applying an external force thereon the deflector (50). More specifically, the guiding member (60) has a track (not shown). The deflector (50) is slidably moving on the surface of the track. The deflector (50) is arranged on the track in such a way that the deflector (50) always has surface contact with the track but is movable between the non-operating positions (50*a*) to the operating position (50*b*).

Figure 3C:
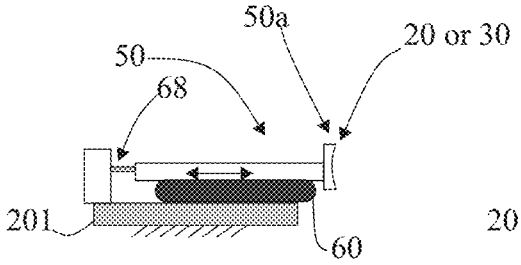
FIGS. 3*c*, 3*d*, 3*e*, 3*f*, and 3*g* shows schematic views of various embodiments a guiding member of the mechanism shown in FIGS. 3*a* and 3*b;*
Figure 3D:
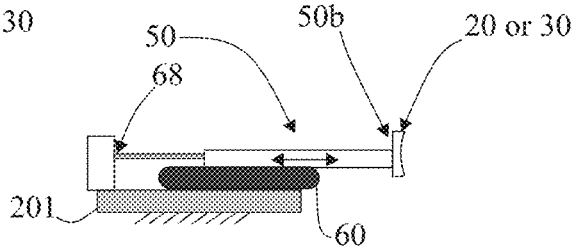

The external force on the deflector (50) can be applied manually. In one more embodiment (FIG. 3*c* and FIG. 3*d*), a first force applying unit (68) connected to the deflector (50). The first force applying unit (68) is a motor or a plunger or a spring or any obvious functional elements capable of applying force on the deflector (50) for moving the deflector (50) between the non-operating position (50*a*) and the operating position (50*b*).

Figure 3E:
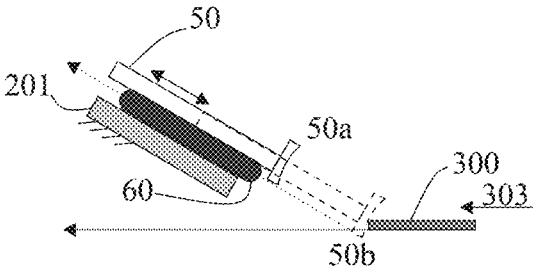
Figure 3F:
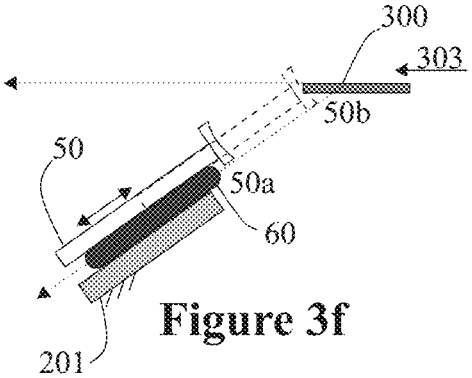

In one of the embodiments of the mechanism (100*a* or 100*b*), the guiding member (60) is angularly oriented with reference to the entry direction (303). The guiding member (60) can be angularly oriented with reference to the entry direction (303) in various angular orientations, as shown in FIGS. 3*e* and 3*f*.

Figure 3G:
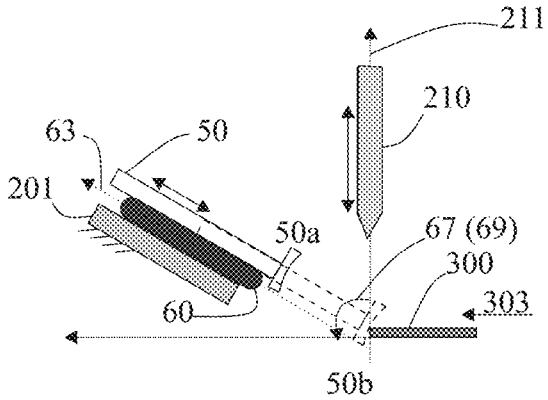

In one more embodiment of the mechanism (100*a* or 100*b*) (FIG. 3*g*), an angle (67) between a direction of extension (63) of the guiding member (60) and a direction of extension of the knife blade (211) is in a range of 20 to 160 degree in an anti-clock wise direction (69).

Figure 4A:
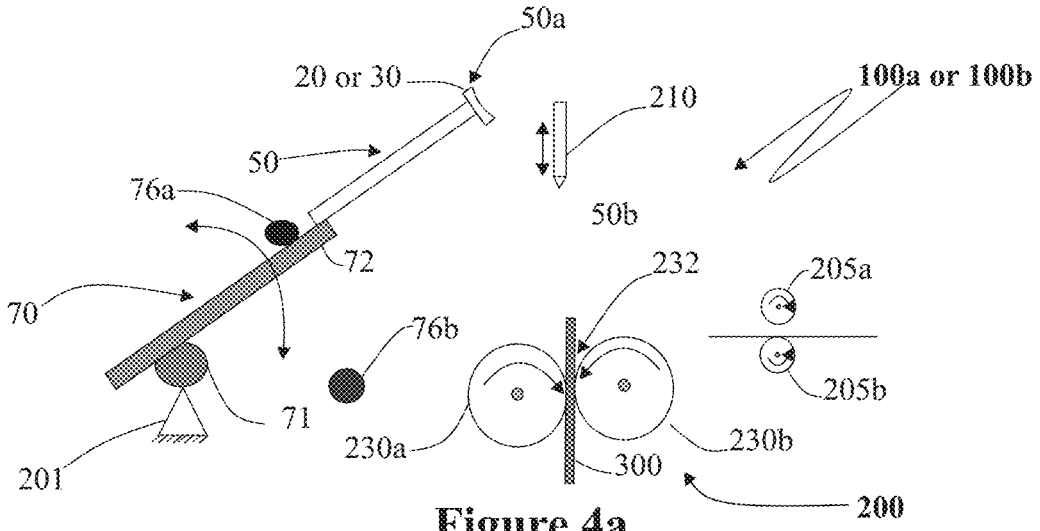
FIGS. 4*a* and 4*b* shows schematic views of one more embodiment of a mechanism for preventing folding of an intermediate in the knife folder shown in FIGS. 1*a*, 1*b* and 1*c* in accordance with the present invention.
Figure 4B:
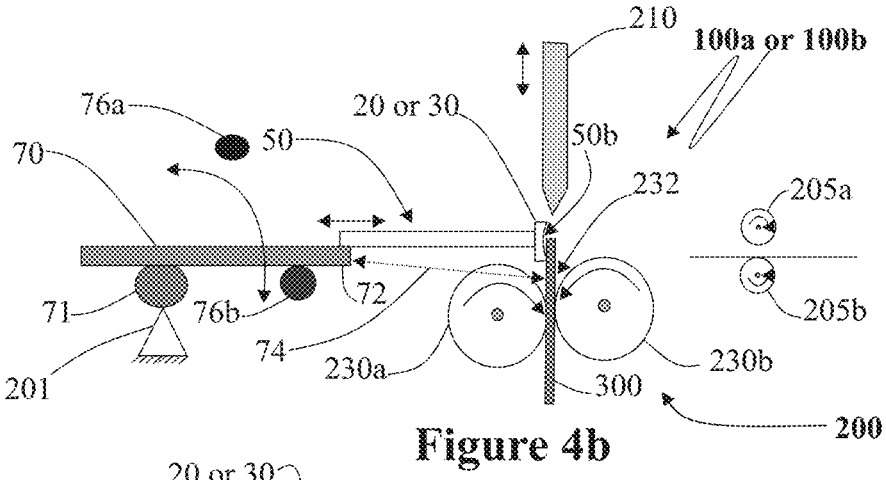

In one more embodiment of the mechanism (100*a* or 100*b*) (FIGS. 4*a* and 4*b*), the mechanism (100*a* or 100*b*) includes a fulcrum lever (70) pivotally connected to the frame (201) of the knife folder (200) at a pivotal pin (71). The deflector (50) is mounted on a first bar end (72) of the fulcrum lever (70). The first bar end (72) is a non-pivoted end of the fulcrum lever (70). The fulcrum lever (70) enables revolving movements of the deflector (50) between the non-operating position (50*a*) and the operating position (50*b*) around the pivotal pin (71) when an external force applied on the fulcrum lever (70) accordingly. When the deflector (50) is at the operating position (50*b*), the first bar end (72) is at a predefined second distance (74) from the roller gap (232). The external force can be applied manually.

Figure 4C:
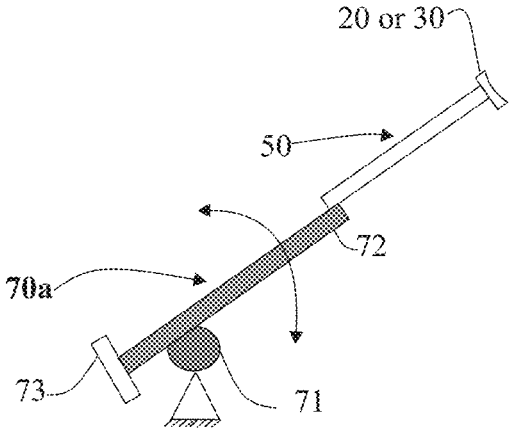
FIGS. 4*c* and 4*d* show schematic views of various embodiments a fulcrum lever of the mechanism shown in FIGS. 4*a* and 4*b;*

In an embodiment of the fulcrum lever (70*a*) (as shown in FIG. 4*c*), the fulcrum lever (70*a*) has a handle (73) extending from the first bar end (72) away from the first bar end (72). The handle (73) is accessible to a user to apply force on the fulcrum lever (70*a*) to revolving the deflector (50) between the non-operating position (50*a*) and the operating position (50*b*).

Figure 4D:
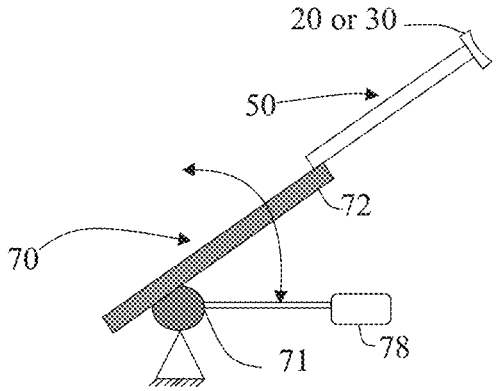

In one more embodiment (as shown in FIG. 4*d*), the fulcrum lever (70) is connected to a second force applying unit (78). The second force applying unit (78) is a motor or a plunger or a spring or any obvious functional elements capable of applying force on the fulcrum lever (70) for moving the deflector (50) between the non-operating position (50*a*) and the operating position (50*b*). Further, the mechanism (100*a* and 100*b*) has two or more stoppers (76*a* and 76*b*) (FIGS. 4*a* and 4*b*) extending from the frame (201) for restricting revolving movements of the deflector (50) beyond the non-operating position (50*a*) and the operating position (50*b*). The stoppers (76*a* and 76*b*) are mechanical.

Figure 5A:
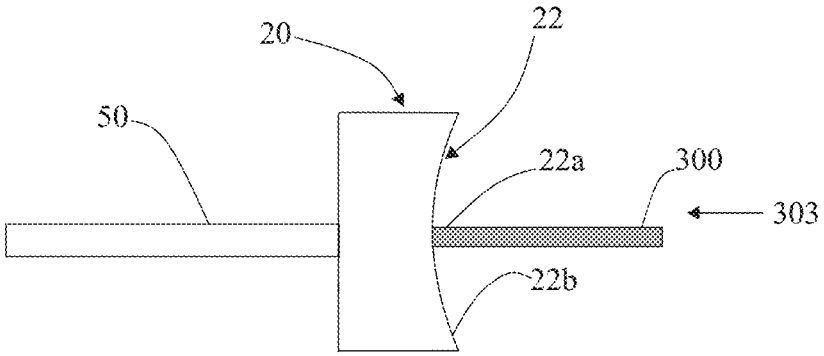
FIGS. 5*a* and 5*b* shows schematic views of one embodiment of a deflector end of the mechanism shown in FIGS. 2*a*, 2*b*, 2*c*, 3*a*, 3*b*, 4*a* & 4*b;*
Figure 5B:
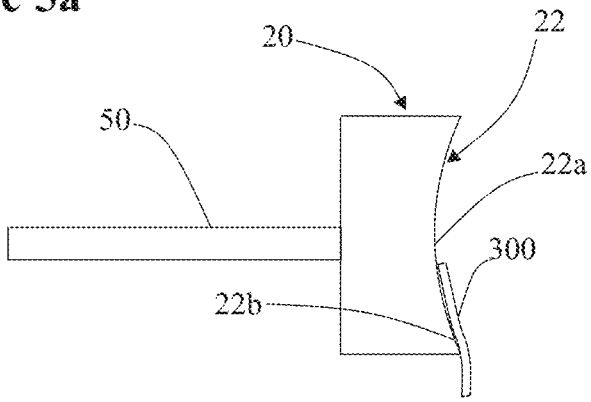

In one more embodiment of the mechanism (100*a* or 100*b*) (FIG. 5*a*), the deflector end (20) has a concave surface face (22). The concave surface face (22) is projected away from the deflector (50). The concave surface face (22) includes a centre concave portion (22*a*) and a lower concave surface (22*b*). The centre concave portion (22*a*) is adapted to stop the linear movement of the intermediate item (300) in the entry direction (303) when the moving intermediate item (300) touches the centre concave portion (22*a*) (FIG. 5*a*). The lower concave surface (22*b*) is adapted to deviate the movement of the intermediate item (300) towards the roller gap (232) (FIG. 5*b*).

Figure 6A:
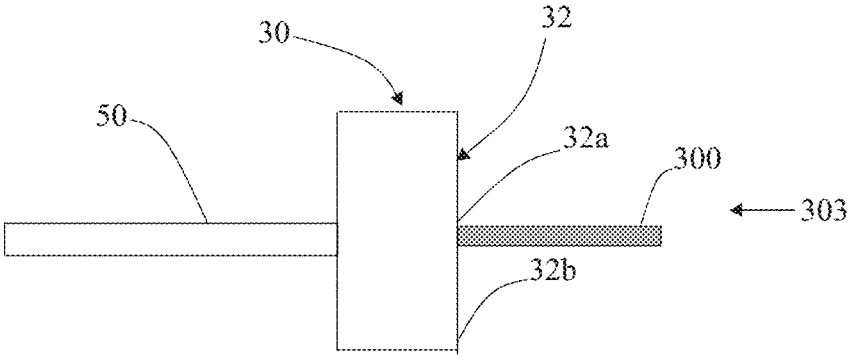
FIGS. 6*a* & 6*b* show schematic views of one more embodiment of a deflector end of the mechanism shown in FIGS. 2*a*, 2*b*, 2*c*, 3*a*, 3*b*, 4*a* &4*b;*
Figure 6B:
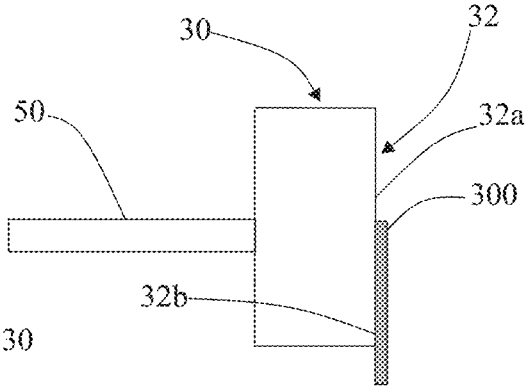

In one more embodiment of the mechanism (100*a* or 100*b*), the deflector end (30) has a straight-line surface face (32) (FIGS. 6*a* and 6*b*). The straight-line surface face (32) is projected away from the deflector (30). The straight-line surface face (32) includes a centre portion (32*a*) and a lower straight surface (32*b*). The centre portion (32*a*) (FIG. 6*a*) is adapted to stop the linear movement of the intermediate item (300) in the entry direction (303) when the moving intermediate item (300) touches the centre portion (32*a*). The lower straight surface (32*b*) adapted to deviate the movement of the intermediate item (300) (FIG. 6*b*) towards the roller gap (232).

Figure 7A:
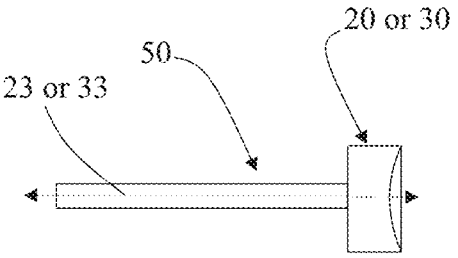
FIGS. 7*a*, 7*b* & 7*c* show schematic views of one more embodiment of a deflector end of the mechanism shown in FIGS. 2*a*, 2*b*, 2*c*, 3*a*, 3*b*, 4*a* & 4*b;*
Figure 7B:
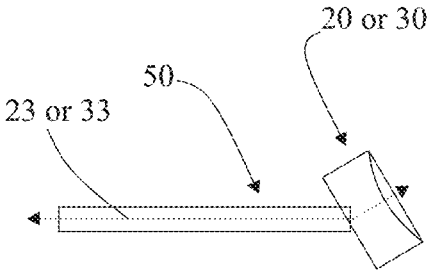
Figure 7C:
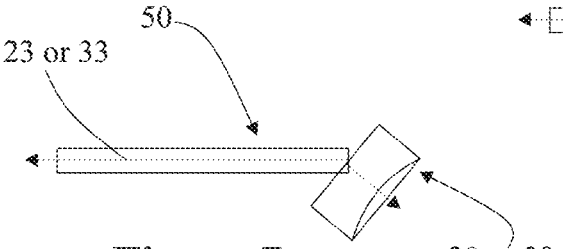

In one more embodiment of the mechanism (100*a* or 100*b*), the deflector end (20 or 30) is angularly oriented from a direction of extension (23 or 33) of the deflector (20 or 30). The deflector end (20 or 30) is angularly oriented from the direction of extension (23 or 33) of the deflector (20 or 30) in various angular orientations, as shown in FIGS. 7*a*, 7*b* & 7*c*.

The deflector (50) is moved between the non-operating position (50*a*) and the operating position (50*b*) with various types of movements (sliding, revolving) various possible functional elements such as the guiding member (60), the fulcrum lever (70) and the deflector end (20 and 30) as shown in FIGS. 3*a*, 3*b*, 3*c*, 3*d*, 3*e*, 3*f*, 3*g*, 4*a*, 4*b*, 4*c*, 4*d*, 5*a*, 5*b*, 6*a*, 6*b*, 7*a*, 7*b* & 7*c* based on the availability of space in the knife folder (200) and other deterministic factors.

Figure 8A:
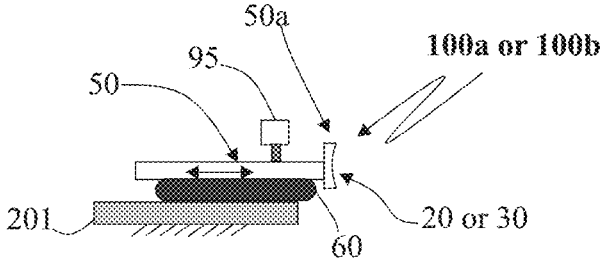
FIGS. 8*a* & 8*b* shows schematic views of a mechanism for preventing folding of an intermediate in the knife folder shown in FIGS. 1*a*, 1*b* and 1*c* in accordance with the present invention.
Figure 8B:
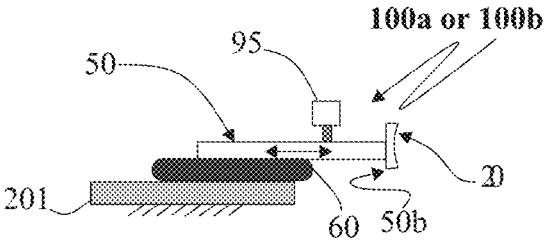

In one more embodiment of the mechanism (100*a* or 100*b*), the mechanism (100*a* or 100*b*) includes a latching unit (95) (FIGS. 8*a* and 8*b*) for latching the deflector (50) at a position between the operating position (50*b*) (FIG. 8*b*) or the non-operating position (50*a*) (FIG. 8*a*). The latching unit (95) can be a grub screw or a plunger lock, or any other latching unit adapted to latch the mechanism (100*a* or 100*b*) at the position between the operating position (50*b*) and the non-operating position (50*b*). The position can be at the operating position (50*b*) or the non-operating position (50*b*).

Figure 9A:
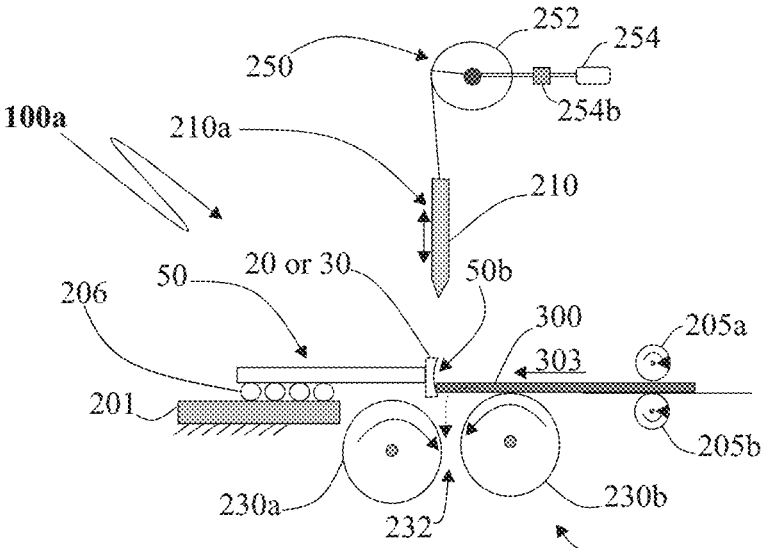
FIGS. 9*a* & 9*b* shows schematic views of one more embodiment of a mechanism for preventing folding of an intermediate in the knife folder shown in FIGS. 1*a*, 1*b* and 1*c* in accordance with the present invention.
Figure 9B:
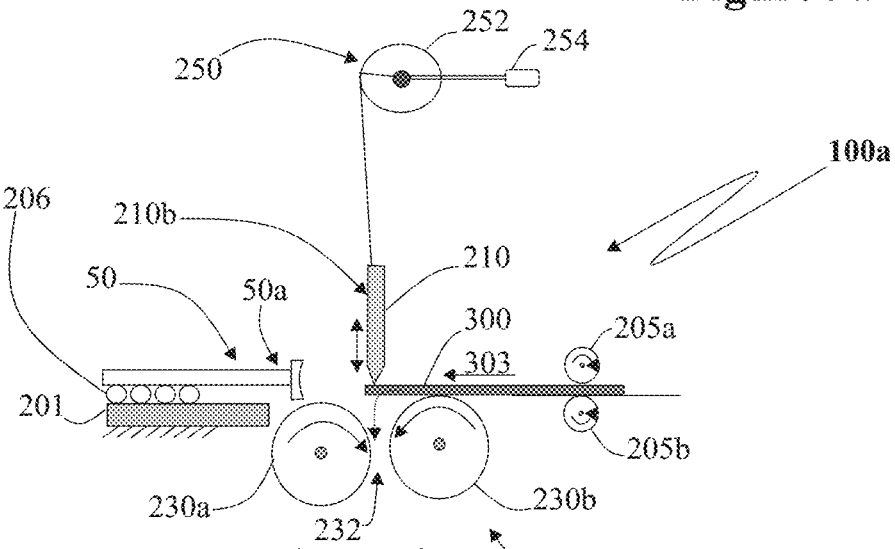

Referring now to FIGS. 9*a* & 9*b*, schematic views of one of the embodiments of the mechanism (100*a*) in accordance with the present invention are illustrated. In the mechanism (100*a*), the deflector (50) is moved to the operating position (50*b*) when the knife blade (210) is at the non-operating knife position (210*a*) (FIG. 9*a*). The deflector (50) is moved to a non-operating position (50*a*) when the knife blade (210) is at the operating knife position (210*b*) (FIG. 9*b*). In the existing knife folder (200), the knife blade (210) is connected to a slider-crank mechanism (250) for moving the knife blade (210) between the non-operating knife position (210*a*) and the operating knife position (210*b*). A rotating member (252) of the slider-crank mechanism (250) is connected to a motor (254) for providing rotational motions to the slider-crank mechanism (250). In an alternate embodiment, the slider mechanism (250) can also be driven by a Pneumatic or a hydraulic or an electric actuator.

The functioning of the motor (254) is stopped accordingly to stop the knife blade (210) at the non-operating knife position (210*a*) (FIG. 9*a*). A person ordinarily skilled in the art is aware to stop functioning of the motor (254) accordingly stop the knife blade (210) at the non-operating knife position (210*a*).

Also, when the deflector (50) is at the operating position (50*b*), a connection (254*b*) between the motor (254) and the rotating member (252) can be decoupled for restricting the movements of the knife blade (210) towards the operating knife position (210*b*). The connection (254*b*) can be decoupled when the knife blade (210) is at the non-operating knife position (210*a*).

Figure 10A:
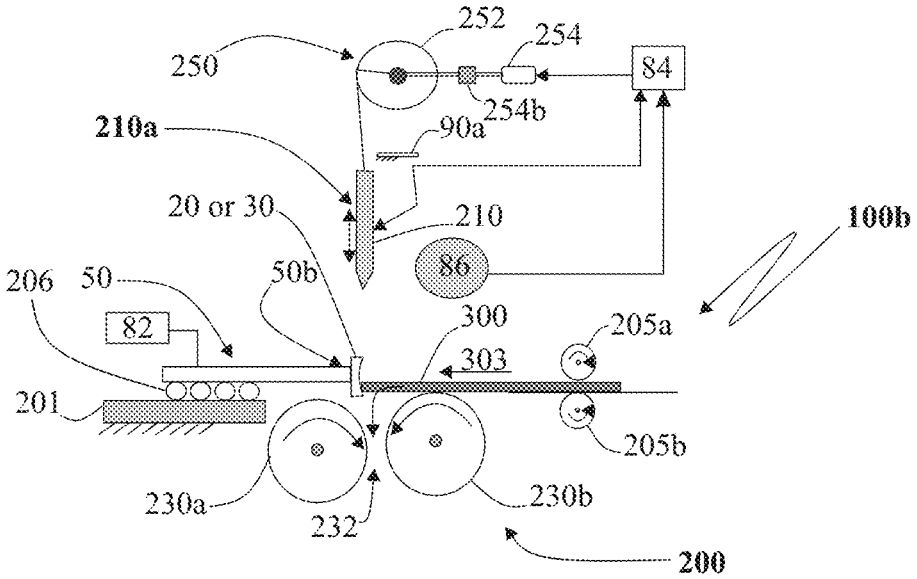
FIGS. 10*a* & 10*b* shows schematic views of one more embodiment of a mechanism for preventing folding of an intermediate in the knife folder shown in FIGS. 1*a*, 1*b* and 1*c* in accordance with the present invention.
Figure 10B:
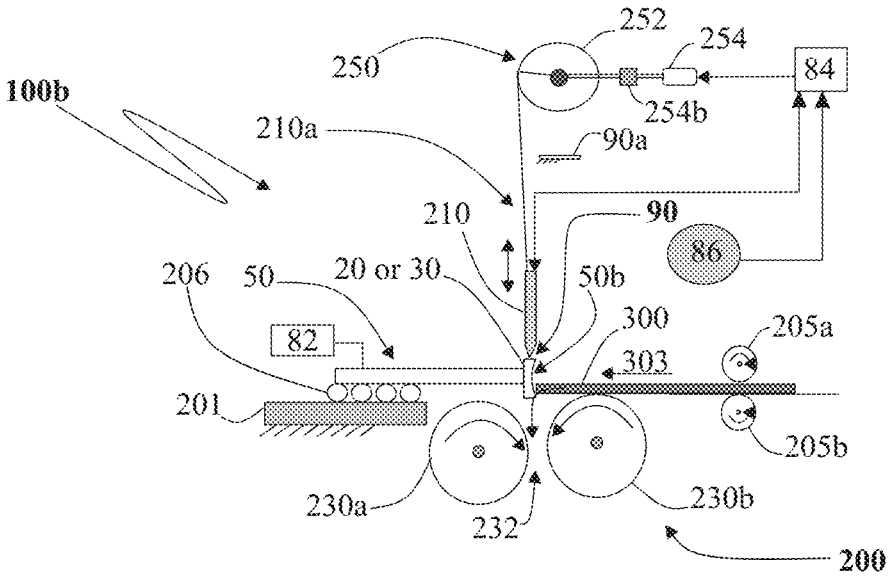

Referring now to FIGS. 10*a*, 10*b* & 10C, schematic views of one of the embodiments of the mechanism (100*b*) in accordance with the present invention are illustrated. In the mechanism (100*b*), when the deflector (50) is at the operating position (50*b*) if the knife blade (210) is moving towards the operating knife position (210*b*) (FIGS. 10*a* and 10*b*), the knife blade (210) is moved backwards from an interference position (90) (FIG. 10*b*) towards the non-operating knife position (210*a*) (FIG. 10*a*). The interference position (90) is a position where the deflector (50) and the knife blade (210) have a physical contact therebetween.

More specifically, the mechanism (100*b*) includes a first controller (82), a second controller (84) and a detecting unit (86). The first controller (82) is connected to the deflector (50) for controlling movements of the deflector (50) between the non-operating position (50*a*) and the operating position (50*b*). The first controller (82) can be a mechanical controller such as a brake, a stopper and the like. The second controller (84) is connected to the knife blade (210) for controlling movements of the knife blade (210) between the non-operation knife position (210*a*) and the operation knife position (210*b*). In the existing knife folder (200), the knife blade (210) is connected to a slider-crank mechanism (250) for moving the knife blade (210) between the non-operating knife position (210*a*) and the operating knife position (210*b*) and a rotating member (252) of the slider-crank mechanism (250) is connected to a motor (254) for providing rotational motions to the slider-crank mechanism (250); then the second controller (84) is a controlling unit which controls the rotation of the motor (254). The second controller can be an electronic controller having a set of hardware and a set of software to control the rotation of the motor.

The detecting unit (86) can be a position sensor or an interference detection sensor. The detecting unit (86) is connected to the second controller (84) to provide information about the position of the knife blade (210) at the interference position (90) to the second controller (84). The second controller (84) is adapted to move the knife blade (210) backwards from the interference position (90) towards the non-operating knife position (210*a*). The position of the interference position (90) with respect to a reference (90*a*) depends on various parameters such as the geometry of the deflector (50) and the knife blade (210), the speed of the movements of the deflector (50) and the knife blade (210) and the like. The reference (90*a*) is any member of the knife folder (200), which is not having a relative motion with respect to any other links of the knife folder (200).

Hence, the position of the interference position (90) with respect to the reference (90*a*) is obtained by performing operation trails of the mechanism (100*a* or 100*b*) by moving the configured deflector (50) between the non-operating position (50*a*) and the operating position (50*b*), and the knife blade (210) is movable between a non-operating knife position (210*a*) and an operating knife position (210*b*) at predefined speeds.

Therefore, the present invention has the advantage of providing the mechanism (100*a* or 100*b*) for preventing the folding of the intermediate item (300) in the knife folder (200). As the deflector (50) moves the received intermediate (300) away from the knife folder (200) without allowing a folding operation by the knife blade (210), the unfolded intermediate item (300) moves away from the knife folder (200). The mechanism (100*a* or 100*b*) prevents the folding of the intermediate item (300) in the knife folder (200) even if the intermediate item (300) is transferred to the knife folder (200). Therefore, the mechanism (100*a* or 100*b*) avoids the need of removing the knife folder (200) from machinery (not shown) between two other machines of the machinery when there is a need to prevent folding of the intermediate item in the knife folder, thereby reduces the duration of the machine set up time.

The foregoing descriptions of specific embodiments of the present invention have been presented for purposes of illustration and description. They are not intended to be exhaustive or to limit the present invention to the precise forms disclosed, and obviously, many modifications and variations are possible in light of the above teaching. The embodiments were chosen and described to explain best the principles of the present invention and its practical application and enable others skilled in the art to utilise best the present invention and various embodiments with various modifications suited to the particular use contemplated. It is understood that various omissions and substitutions of equivalents are contemplated as circumstances may suggest or render expedient, but such omissions and substitutions are intended to cover the application or implementation without departing from the scope of the claims of the present invention.

We claim:

1. A mechanism (100 *a* or 100 *b*) for preventing folding of an intermediate item (300) in a knife folder (200), the intermediate item (300) is a sheet having one or more folds (302, 304) thereon, the knife folder (200) includes a knife blade (210), a stopper (220) and one or more pairs folding rollers (230 *a* and 230 *b*), the knife blade (210) is movable between a non-operating knife position (210 *a*) and an operating knife position (210 *b*); and for folding the intermediate item (300) by the knife folder (200), the intermediate item (300) is moved on the folding rollers (230 *a* and 230 *b*), the knife blade (210) is moved to the operating knife position (210 *b*) to press on a fold line (303) of the received intermediate item (300), the stopper (220) restricts a linear movement of the intermediate item (300) on the folding rollers (230 *a* and 230 *b*) in an entry direction (303) of the intermediate item (300) and the folding rollers (230 *a* and 230 *b*) are rotated to fold the intermediate item (300) and moves the folded intermediate item (300 *a*) through a roller gap (232) between the folding rollers (230 *a* and 230 *b*), the non-operating knife position (210 *a*) is a position of the knife blade (210) at which the knife blade (210) is not in a physical contact with the intermediate item (300), the mechanism (100 *a* or 100 *b*) comprises:

a deflector (50) movably arranged on a frame (201) of the knife folder (200), the deflector (50) is movable between a non-operating position (50 *a*) and an operating position (50 *b*), the non-operating position (50 *a*) is a position of the deflector (50) at which a deflector end (20 or 30) of the deflector (50) is not in a physical contact with the intermediate item (300) received at the knife folder (200), the operating position (50 *b*) is a position where the deflector end (20) of the deflector (50) is physically in contact with the intermediate item (300);

wherein for preventing the folding of the intermediate item (300) by the knife folder (200), when the intermediate item (300) is moving on the folding rollers (230 *a* and 230 *b*), the deflector (50) is moved to the operating position (50 *b*) for deflecting the received intermediate item (300) towards the roller gap (232) by the deflector end (20) of the deflector (50); and upon rotation of the folding rollers (230 *a* and 230 *b*), the intermediate item (300) moves away from the knife folder (200) through the roller gap (232).

2. The mechanism (100 *a*) as claimed in claim 1, wherein the deflector (50) is moved to the operating position (50 *b*) when the knife blade (210) is at the non-operating knife position (210 *a*).

3. The mechanism (100 *a* or 100 *b*) as claimed in claim 1, wherein the deflector end (20) has a concave surface face (22), the concave surface face (22) is projected away from the deflector (50), the concave surface face (22) includes:

a centre concave portion (22 *a*) adapted to stop the linear movement of the intermediate item (300) in the entry direction (303) when the moving intermediate item (300) touches the centre concave portion (22 *a*); and a lower concave surface (22 *b*) adapted to deviate the movement of the intermediate item (300) towards the roller gap (232).

4. The mechanism (100 *a* or 100 *b*) as claimed in claim 1, wherein the deflector end (30) has a straight-line surface face (32), the straight-line surface face (32) is projected away from the deflector (30), the straight-line surface face (32) includes:

a centre portion (32 *a*) adapted to stop the linear movement of the intermediate item (300) in the entry direction (303) when the moving intermediate item (300) touches the centre portion (32 *a*); and a lower straight surface (32 *b*) adapted to deviate the movement of the intermediate item (300) towards the roller gap (232).

5. The mechanism (100 *a* or 100 *b*) as claimed in claim 1, wherein the mechanism (100 *a* or 100 *b*) includes a guiding member (60) connected to the frame (201) of the knife folder (200), the guiding member (60) is extending towards the roller gap (232) with a distal end (62) of the guiding member (60) at a predefined first distance (64) from the roller gap (232), the deflector (50) is slidably moved on the guiding member (60) from the non-operating position (50 *a*) to the operating position (50 *b*) by applying an external force thereon.

6. The mechanism (100 *a* or 100 *b*) as claimed in claim 5, wherein the external force can be applied manually or by a first force applying unit (68) connected to the deflector (50).

7. The mechanism (100 *a* or 100 *b*) as claimed in claim 5, wherein the guiding member (60) is angularly oriented with reference to the entry direction (303).

8. The mechanism (100 *a* or 100 *b*) as claimed in claim 5, wherein an angle (67) between a direction of extension (63) of the guiding member (60) and a direction of extension of the knife blade (211) is in a range of 20 to 160 degree in an anti-clockwise direction (69).

9. The mechanism (100 *a* or 100 *b*) as claimed in claim 1, wherein the mechanism (100 *a* or 100 *b*) includes a fulcrum lever (70) pivotally connected to the frame (201) of the knife folder (200) at a pivotal pin (71), the deflector (50) is mounted on a first end bar (72) of the fulcrum lever (70), the fulcrum lever (70) enables revolving movements of the deflector (50) between the non-operating position (50 *a*) and the operating position (50 *b*) around the pivotal pin (71) when an external force applied on the fulcrum lever (70) accordingly; and when the deflector (50) is at the operating position (50 *b*), the first bar end (72) is at a predefined second distance (74) from the roller gap (232).

10. The mechanism (100 *a* or 100 *b*) as claimed in claim 9, wherein the external force can be applied manually or by a second force applying unit (78) connected to the fulcrum lever (70).

11. The mechanism (100 *b*) as claimed in claim 1, wherein the when the deflector (50) is at the operating position (50 *b*) if the knife blade (210) is moving towards the operating knife position (210 *b*), the knife blade (210) is moved backwards from an interference position (90) towards the non-operating knife position (210 *a*), the interference position (90) is a position where the deflector (50) and the knife blade (210) has a physical contact therebetween.

12. The mechanism (100 *b*) as claimed in claim 11, wherein the mechanism (100 *b*) having:

a first controller (82) connected to the deflector (50) for controlling movements of the deflector (50) between the non-operating position (50 *a*) and the operating position (50 *b*);

a second controller (84) connected to the knife blade (210) for controlling movements of the knife blade (210) between the non-operation knife position (210 *a*) and the operation knife position (210 *b*);

a detecting unit (86) connected to the second controller (84) to provide information about the position of the knife blade (210) at the interference position (90) to the second controller (84), and the second controller (84) is adapted to move the knife blade (210) backwards from the interference position (90) towards the non-operating knife position (210 *a*).

13. The mechanism (100 *a* or 100 *b*) as claimed in claim 1, wherein the deflector end (20 or 30) is angularly oriented from a direction of extension (23 or 33) of the deflector (20 or 30).

14. The mechanism (100 *a* or 100 *b*) as claimed in claim 1, wherein the mechanism (100 *a* or 100 *b*) includes a latching unit (95) for latching the deflector (50) at a position between the operating position (50 *b*) and the non-operating position (50 *b*).

* * * * *